US009179746B2

(12) United States Patent
Gullo

(10) Patent No.: US 9,179,746 B2
(45) Date of Patent: Nov. 10, 2015

(54) CONVERTIBLE WALKING STICK

(71) Applicant: Paolo Gullo, Sheffield (GB)

(72) Inventor: Paolo Gullo, Sheffield (GB)

( * ) Notice: Subject to any disclaimer, the term of this patent is extended or adjusted under 35 U.S.C. 154(b) by 0 days.

(21) Appl. No.: 14/483,939

(22) Filed: Sep. 11, 2014

(65) Prior Publication Data

US 2015/0075576 A1 Mar. 19, 2015

(30) Foreign Application Priority Data

Sep. 13, 2013 (GB) ..... 1316346.4

(51) Int. Cl.
*A45B 5/00* (2006.01)
*A47C 9/10* (2006.01)

(52) U.S. Cl.
CPC .. *A45B 5/00* (2013.01); *A47C 9/105* (2013.01)

(58) Field of Classification Search
CPC ..... A45B 3/00; A45B 5/00; A47C 9/10; A47C 9/105
See application file for complete search history.

(56) References Cited

U.S. PATENT DOCUMENTS

| | | | | | |
|---|---|---|---|---|---|
| 11,271 | A | * | 7/1854 | Porter | 248/155.3 |
| 345,852 | A | * | 7/1886 | Leermo | 248/155.2 |
| 391,901 | A | * | 10/1888 | Leisner | 248/155.2 |
| 455,345 | A | * | 7/1891 | Lovejoy | 248/435 |
| 473,534 | A | * | 4/1892 | van Gilder | 108/33 |
| 484,334 | A | * | 10/1892 | More | 248/155.2 |
| 486,074 | A | * | 11/1892 | Benoit | 248/155.2 |
| 499,719 | A | * | 6/1893 | Dabney | 248/155.2 |
| 542,609 | A | * | 7/1895 | Gordon et al. | 248/155.3 |
| 546,895 | A | * | 9/1895 | Leovy | 248/435 |
| 663,105 | A | * | 12/1900 | Skoog et al. | 248/155.2 |
| 763,166 | A | * | 6/1904 | Dougherty | 248/155.3 |
| 952,335 | A | * | 3/1910 | Killian | 248/155.1 |
| 964,381 | A | * | 7/1910 | Boyd | 248/155 |
| 1,089,295 | A | * | 3/1914 | Wallier | 248/155.1 |
| 1,282,105 | A | * | 10/1918 | Mowry | 248/155.2 |
| 1,679,267 | A | * | 7/1928 | Rieger | 248/155 |
| 2,615,494 | A | * | 10/1952 | Ciaramella | 248/435 |
| 2,793,680 | A | * | 5/1957 | Eben | 248/155.1 |
| 3,745,937 | A | * | 7/1973 | Gail | 108/128 |
| 7,219,679 | B2 | * | 5/2007 | Hsu et al. | 135/66 |
| 7,905,667 | B2 | * | 3/2011 | Barker | 396/419 |
| 8,146,876 | B1 | * | 4/2012 | Young et al. | 248/412 |
| 2010/0314926 | A1 | * | 12/2010 | Chesness | 297/258.1 |

* cited by examiner

*Primary Examiner* — David R Dunn
*Assistant Examiner* — Danielle Jackson
(74) *Attorney, Agent, or Firm* — Westman, Champlin & Koehler, P.A.; Z. Peter Sawicki

(57) ABSTRACT

A walking stick includes an upper section and a lower section connected by a boss assembly. The upper section comprises three elongate arm members each pivotal about a hinge located on an upper surface of the boss assembly between a first position in which it is generally upstanding and lies generally parallel with the other two elongate members and a second position in which it is inclined at an angle to the other two elongate arm members. The lower section comprises three elongate leg members each having an upper end positioned for pivotal movement relative to the boss assembly between a first position in which it is generally upstanding and lies generally parallel to the other two elongate leg members and a second position in which it is inclined at an angle to the other two elongate leg members. A foldable seat member is secured to and between each of the three elongate arm members of the upper section which, when the elongate arm members of the upper section which, when the elongate arm members are in their inclined positions, defines a seat.

2 Claims, 7 Drawing Sheets

CONVERTIBLE WALKING STICK

CROSS REFERENCE TO RELATED APPLICATION

This application is based on and claims priority from British Patent Application No. 1316346.4, filed Sep. 13, 2013, in the UK Intellectual Property Office, the disclosure of which is incorporated herein in its entirety by reference.

FIELD OF THE INVENTION

This invention relates to a walking stick and, more especially, to a walking stick which can be converted into a multi-legged seat, and vice versa.

BACKGROUND TO THE INVENTION

Shooting sticks are known which comprise a walking stick formed with a foldable seat of canvas or like material. These sticks have proved to be popular but suffer from the disadvantage that when used as a seat they make only single point contact with the ground. They are therefore inherently unstable and are of limited use to the elderly or others with relatively limited personal stability.

Examples of walking sticks which can be converted into multi-legged seats can be seen from CN101214099, U.S. Pat. Nos. 484,334, 391,901, 389,810, 763,166, 542,609 and CH48155. All of these proposed walking sticks suffer from the disadvantage that, when in their seat configurations, no independent adjustment of the seat legs is possible. This means that when positioned on uneven ground, there is a strong possibility that the seat will be unstable.

Tripod stands for such items as cameras and guns are also known, some of which include a leg or support of adjustable height. Examples of these are to be found in EP1936436, U.S. Pat. Nos. 7,845,602 and 8,146,876.

One object of this invention is to provide a walking stick which can readily be converted to a seat which has three height adjustable points of contact with the ground whether the ground is flat or uneven.

SUMMARY OF THE INVENTION

The invention provides a walking stick which includes an upper section and a lower section connected by a rotatable boss assembly, said upper section comprising three elongate arm members each pivotal about a hinge located on an upper surface of the boss assembly between a first position in which it is generally upstanding and lies generally parallel with the other two elongate arm members and a second position in which it is inclined at an angle to the other two elongate arm members, and said lower section comprising three elongate leg members each including an inner elongate leg located telescopically within a hollow outer elongate leg and each having an upper end positioned for pivotal movement relative to the boss assembly between a first position in which it is generally upstanding and lies generally parallel to the other two elongate members and a second position in which it is inclined at an angle to the other two elongate leg members, said boss assembly comprising an upper member which supports the hinges for the elongate arm members, and a lower member formed with the opening into which the upper ends of the inner legs of the elongate leg members of the lower section project, said boss member having an under surface which is shaped to include a downwardly projecting dome-shaped surface against which the upper ends of the telescopic inner leg members make contact, rotation of the central boss member sequentially imparting vertical movement to each inner elongate leg in turn to deactivate a locking mechanism located within each inner leg member to enable a selected inner leg member to slide within the respective outer leg member to increase the length of the respective lower elongate member, and a foldable seat member secured to and between each of the three elongate arm members of the upper section which, when the elongate arm members are in their inclined positions, defines a seat and when the elongate arm members are in their generally upstanding positions is hidden from view between the inner surfaces of the arm members.

In a preferred arrangement, the boss assembly comprises an upper member from the upper surface of which the hinges for the elongate members of the upper section are upstanding, and a lower member formed with an opening into which the upper ends of the inner legs of the elongate members of the lower section project.

BRIEF DESCRIPTION OF THE DRAWINGS

The invention will now be described by way of example only with reference to the accompanying drawings, in which.

DETAILED DESCRIPTION OF THE INVENTION

Figure 1:
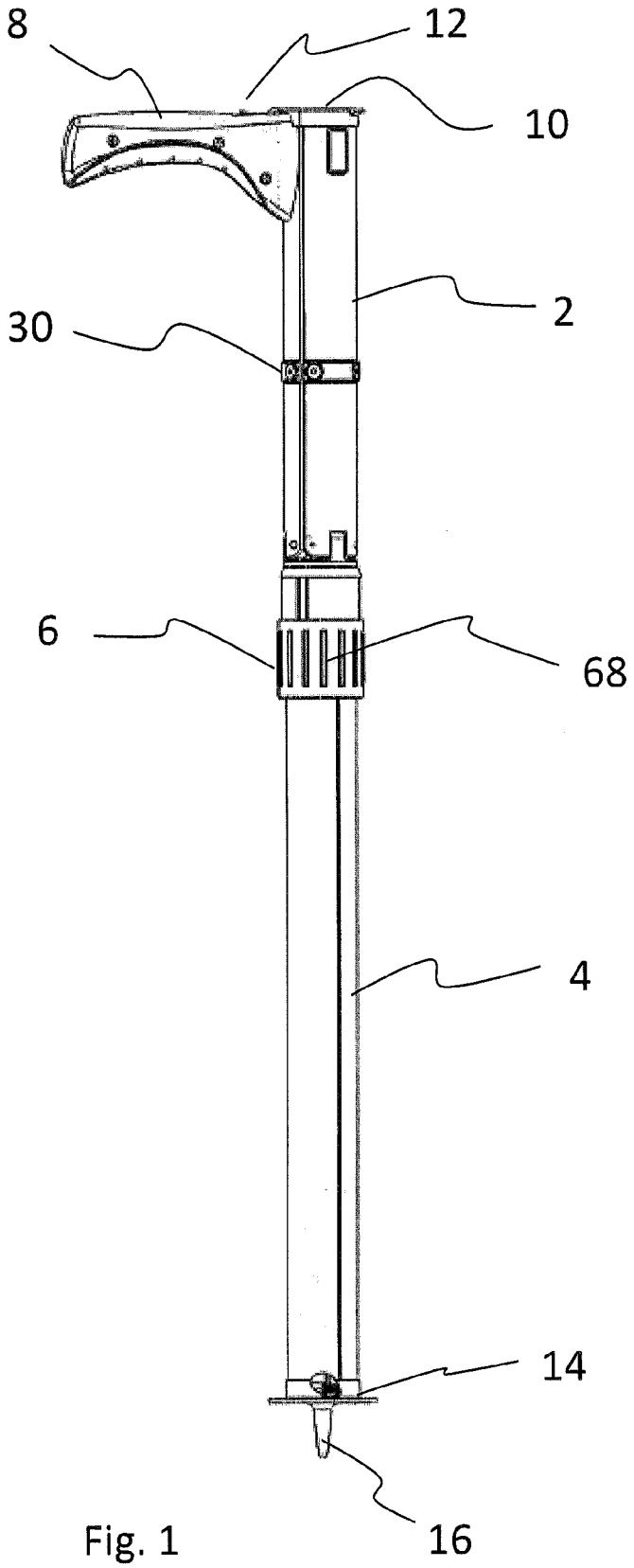
FIG. 1 is a side view of a walking stick in accordance with the invention.

The walking stick illustrated in FIG. 1 comprises an upper handle section 2 and a lower leg section 4 separated by a boss assembly 6. The upper handle section 2 includes an outwardly projecting handle 8 and a cap 10. As will be explained below, the upper handle section 2 comprises three elongate arm members which are so shaped that when the walking stick is in the position shown in FIG. 1 they inter-engage to define a handle section which is generally circular in cross section.

In this position the three inter-engaging arm members are retained in place by the cap 10, a downwardly projecting lip of the cap encircling the upper ends of the individual members. A clip 12 is provided on the handle 8 to release the cap 10 from its seating on the upper end of the upper handle section 2.

Similarly, the lower leg section 4 comprises three elongate leg members shaped to inter-engage to define a lower section which is generally circular in cross section when the walking stick is in the form illustrated in FIG. 1.

Figure 2:
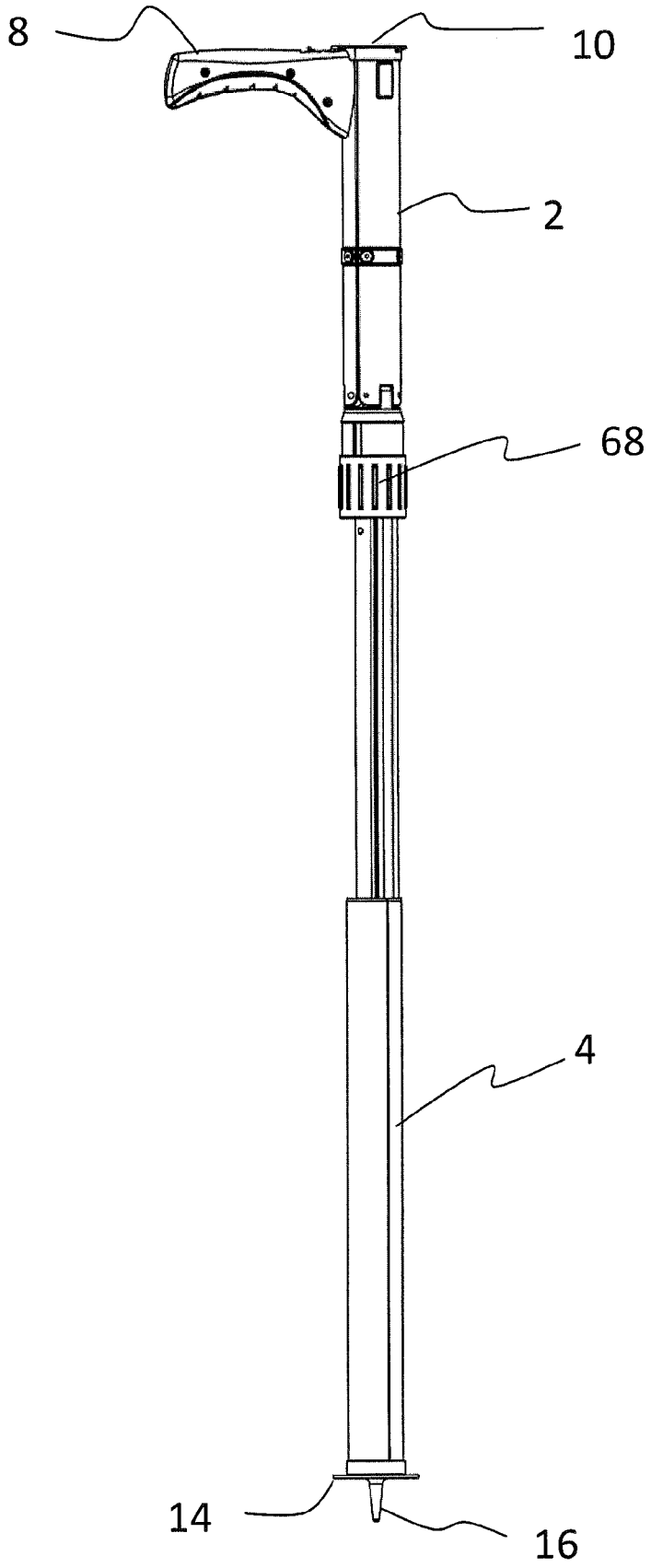
FIG. 2 is a side view of the walking stick shown in FIG. 1 when fully extended.

As will be seen from FIG. 2, the length of the lower leg section 4 is extendable to vary the height of the handle 8 above ground level. The mechanism for extending the length of the lower leg section 4 will be explained below.

As will also be seen from FIGS. 1 and 2, the lower leg section 4 includes a replaceable cap 14 which retains the elongate members of the lower leg section 4 in place when the walking stick is in the form shown in FIGS. 1 and 2. As shown, the underside of the cap 14 includes a downwardly projecting spike 16. The underside of the cap 14 can, however, take many forms depending on the surface over which the walking stick is to be used. Thus, for example, the under surface of the cap 14 may be generally flat and possibly formed with a plurality of serrations to provide added grip when traversing a generally flat surface. It is also the case that the cross-sections of the handle and leg sections 2, 4 can be other than of generally circular.

Figure 3:
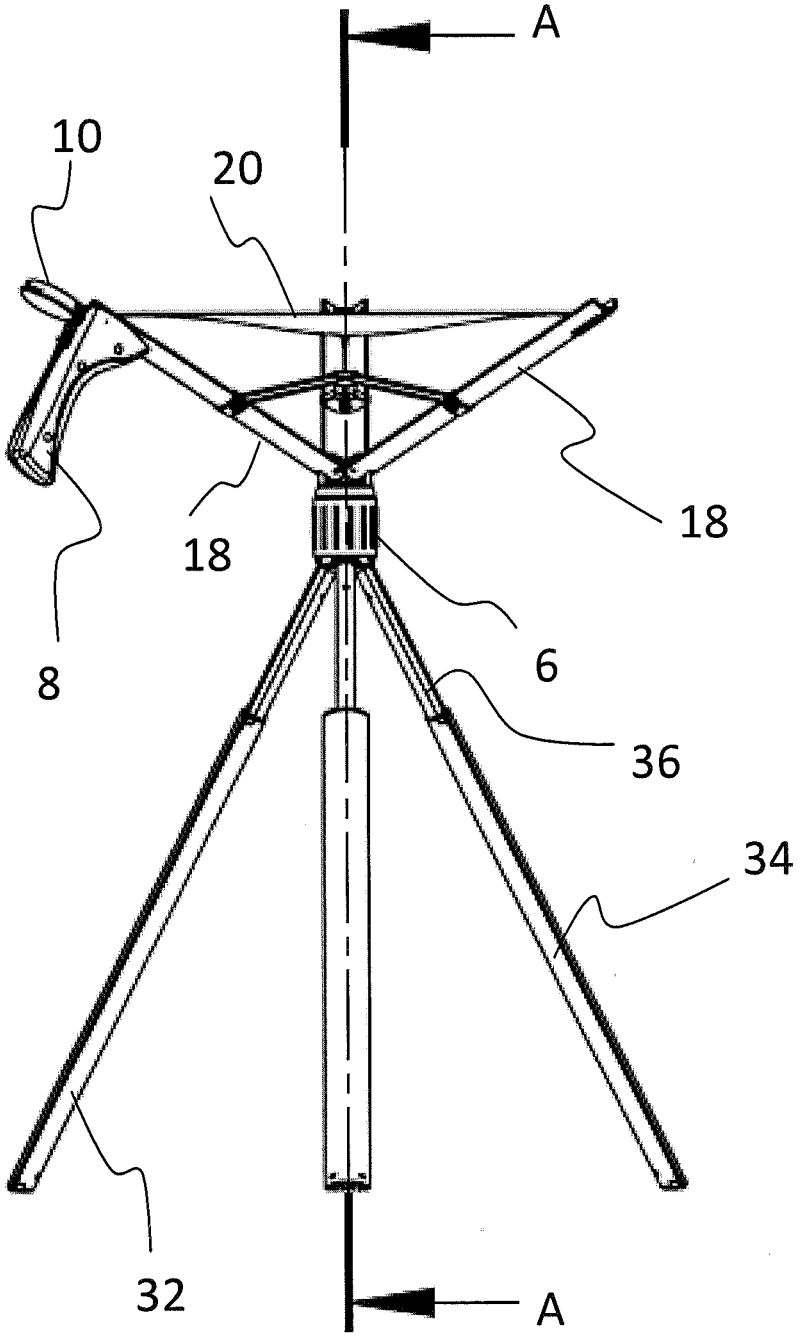
FIG. 3 is a side view of the walking stick of FIGS. 1 and 2 when converted to a seat.
Figure 4:
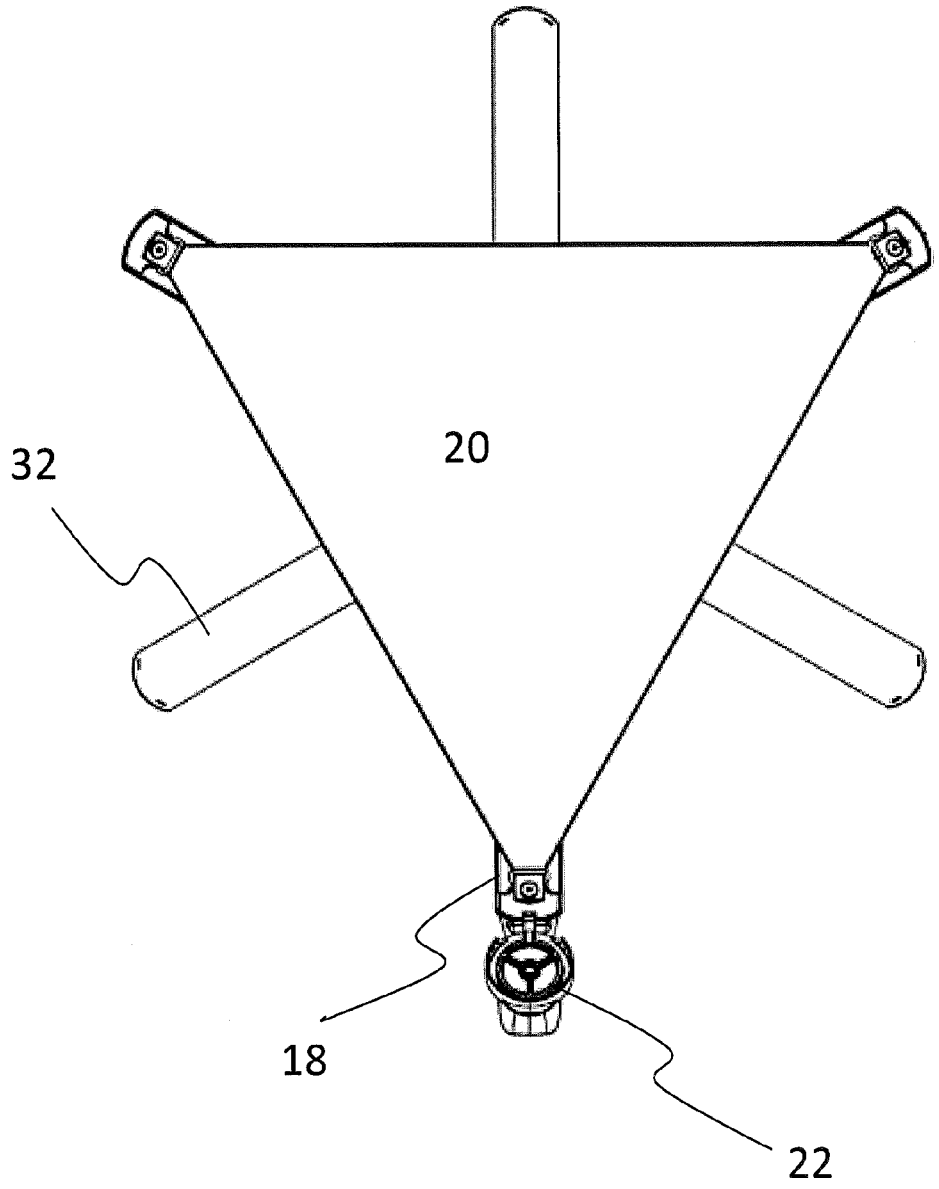
FIG. 4 is a view from above of the converted walking stick illustrated in FIG. 3.

FIG. 3 illustrates the walking stick when converted to a seat. As will be seen from this Figure, the upper handle section 2 of the walking stick comprises three elongate arm members 18 whose uppermost ends are inclined outwardly, the top of each arm member 18 being substantially equidistant above the bush assembly 6. The upper ends of the arm members 18 support a triangular sheet of fabric or like material (see FIG. 4) which defines a seat 20 for a user of the walking stick when the stick is so converted. Each corner of the fabric seat 20 is attached to the upper part of the respective member 18 by a ring 22. As will be seen from FIG. 2, the fabric seat is hidden from view when the handle section 2 is in its folded position, the fabric seat 20 being folded between the inner faces of the arm members 18.

Figure 5:
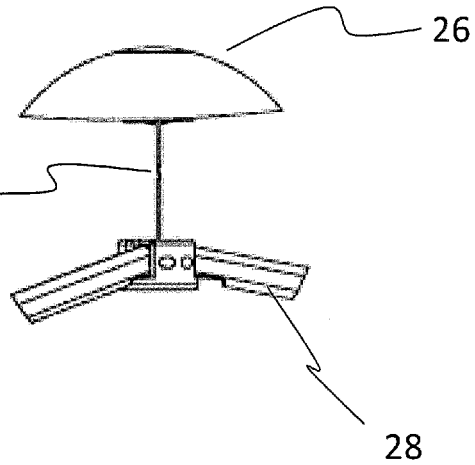
FIG. 5 is a detail of the converted walking stick shown in FIG. 4.
Figure 6:
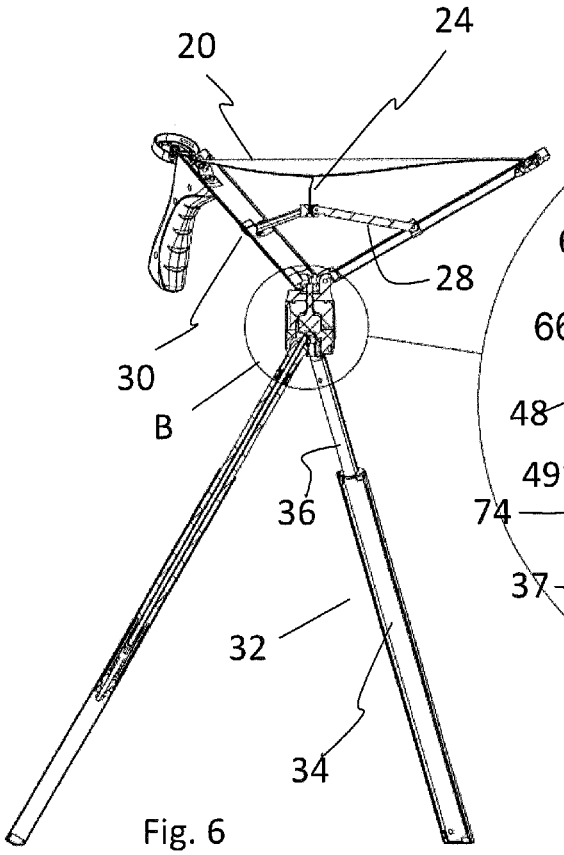
FIG. 6 is a section taken along line A-A of FIG. 3.

As will be seen from FIGS. 5 and 6, to assist folding of the fabric seat 20 between the arm members 18 when the walking stick is as illustrated in FIGS. 1 and 2, an elasticated strip 24 passes through a hole formed in the seat and is secured to the underside of a cap 26 which is positioned above and in contact with the upper surface of the seat 20. The lower end of the elasticated strip 24 is attached to the centre of a suitably shaped series of bands 28 which stretches between each of the three arm members 18. Clips 30 (see FIGS. 1 and 6) are provided around the three arm members 18 to secure the ends of the bands in place.

As will also be seen from FIG. 3, the lower section 4 of the walking stick comprises three elongate leg members 32 which are splayed apart in the shape of a tripod to define the legs for the seat 20. Each leg member 32 comprises an outer sleeve 34 and an inner sleeve 36 which can slide telescopically within the outer sleeve. In this way, the length of the walking stick and the height of the seat 20 above ground level can be varied. As will be seen from FIG. 7, a central rod 37 is positioned within each inner sleeve member 36 and, as will be explained later, is movable vertically within the respective inner sleeve member 36 to enable the length of the leg member 32 to be changed.

Figure 7:
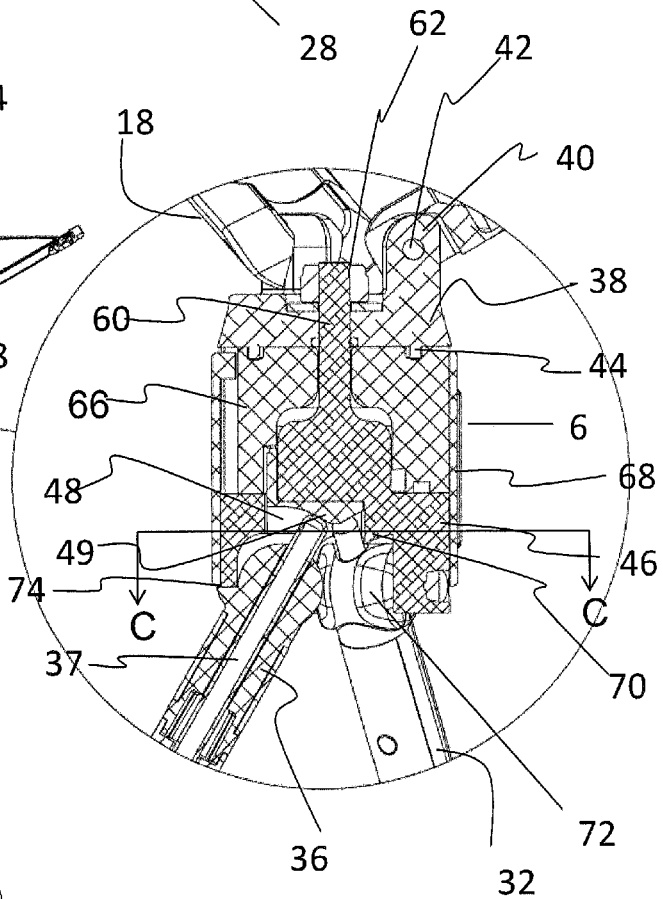
FIG. 7 is a section of detail B of FIG. 6 to an enlarged scale.

The upper and lower sections 2, 4 of the walking stick are secured together through the boss assembly 6. As will be seen from FIGS. 6 and 7, the boss assembly comprises an upper member 38 which includes three upstanding pivot supports 40 (only one of which is illustrated in FIG. 7) each of which is configured to receive and support a spindle 42 secured to the lower end of each arm member 18. In this way, once the cap 10 is removed from the top of the elongate upper handle section 2 of the walking stick, the arm members 18 can be folded from their positions shown in FIGS. 1 and 2 to the positions shown in FIG. 3. A ring 44 (or an annular series of pegs) depends from the underside of the upper boss member 38.

The boss assembly further comprises a lower member 46 formed in its lower surface with an opening 48 into which the upper ends of the inner sleeves 36 of the leg members 32 project. Projecting downwardly into the opening 48 is a domed surface 49 against which the upper ends of the rods 37 abut.

Figure 8:
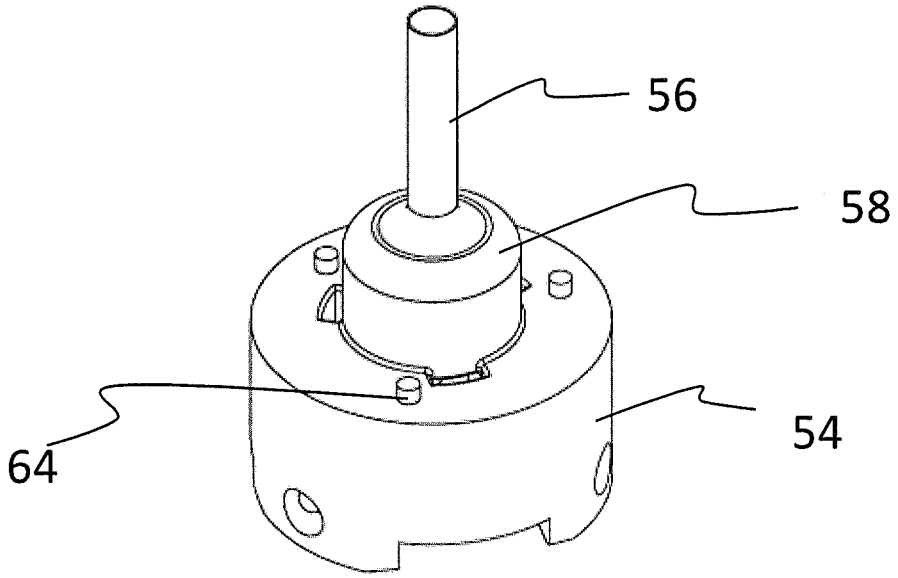
FIG. 8 is an isometric view of a boss member which forms part of FIG. 7.

The lower boss member is also illustrated in FIG. 8 and includes a skirt 54 within which the opening 48 is located and a spindle 56 upstanding from a support surface 58 which is positioned on the upper surface of the skirt 54. The upper end of the spindle 56 is screw-threaded and protrudes upwardly through a central bore 60 of the upper boss member 38 and is retained in place by a suitably threaded nut 62. Protruding from the upper surface of the skirt 54 are three pegs 64 which locate within suitably shaped bores formed in the under surface of a central boss member 66. The pegs 64 prevent relative rotation between the lower and central boss members.

The ring 44 of the upper boss member locates in a channel set in the upper surface of the central boss member 66 thereby enabling relative rotation between the upper and central boss members. Thus, the seat 20 can be rotated relative to the lower leg section 4 of the walking stick. An O-ring is provided between the spindle 56 and the upper boss member 38 to restrict the degree of turning movement of the upper boss member 38 and therefore the seat 20 relative to the leg members of the seat.

The central boss member 66 is rotatable about the vertical axis of the walking stick through manual rotation of a grip 68 positioned about the surface of the walking stick.

Figure 9:
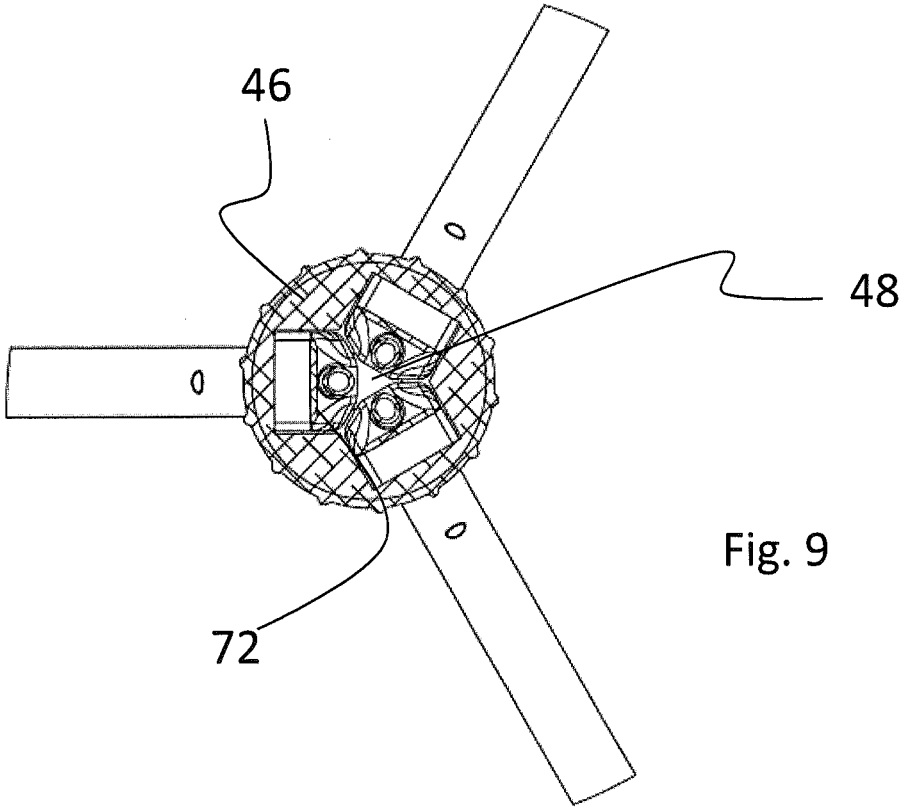
FIG. 9 is a section taken along line C-C of FIG. 7.

As will be seen from FIGS. 7 and 9, guide members 70 protrude inwardly from the internal surface of the opening 48. Three equally spaced guide members are provided, only one of which is shown in FIG. 7. These guide members co-operate to locate the ends of the telescopic leg members 36 accurately within the confines of the opening 48 of the skirt 54.

As will also be seen from FIGS. 7 and 9, the upper end of each inner sleeve member 36 is shaped to define a knuckle 72 which cooperates with the knuckles of the other two inner sleeve members to prevent removal of the inner sleeve ends from the opening 48 defined by the skirt 54 while permitting each inner sleeve to move from its position shown in FIGS. 1 and 2 to the position shown in FIG. 7. The extent to which each inner sleeve can incline is limited by ribs 74 which project from the upper surface of each inner leg member 36 and engage the opposed under surface of the lower boss member 46 when the respective sleeve has reached its maximum inclined position.

Figure 10:
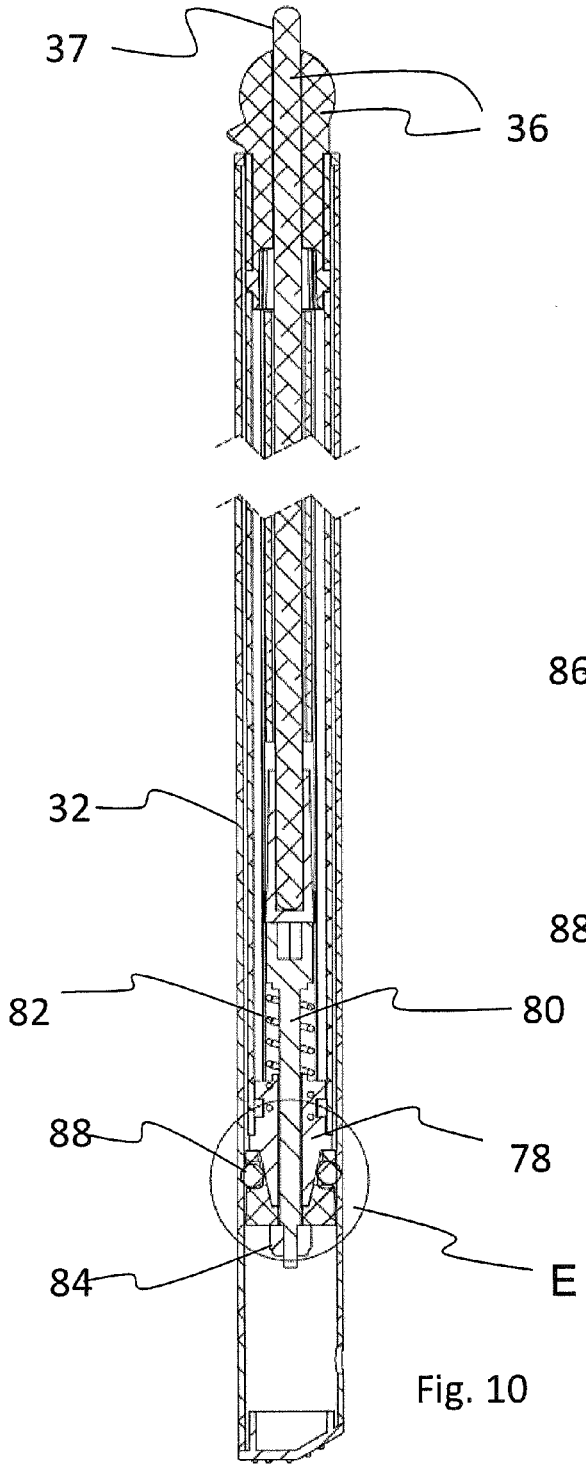
FIG. 10 is a longitudinal section taken through a leg member which forms part of the illustrated walking stick.
Figure 11:
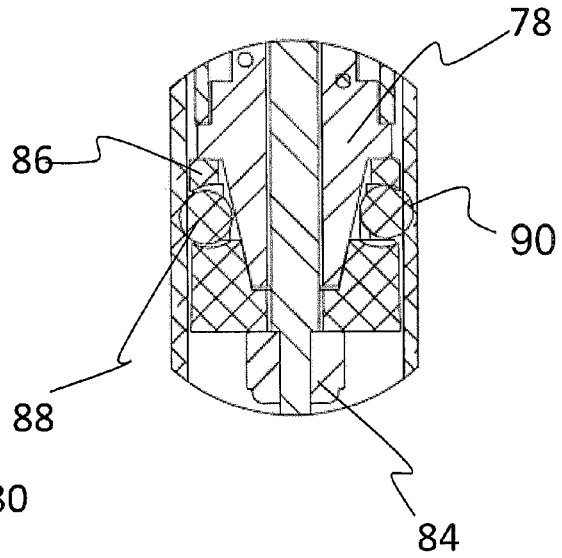
FIG. 11 is an enlarged view of detail E of FIG. 10.

Turning now to FIGS. 10 and 11 of the drawings, as mentioned previously, the central rod 37 of each inner sleeve member 36 forms part of the locking mechanism by which it is possible to change the length of the respective leg member 32 and therefore the length of the walking stick or the height of the seat 20 above ground level. As will be seen from FIG. 7, the upper end of each rod 37 lies in contact with the domed surface 49 of the central boss member 66. Rotation of the central boss member 66 through rotation of the grip 68 therefore causes sequential vertical displacement of the central rods 37.

As will be seen from FIG. 10, the lowermost end of each central rod 37 is connected through a sleeve 76 to a locking member which comprises a cone 78 supported on a shaft 80 about which is positioned a helical spring 82. As will be seen most clearly from FIG. 11, the cone 78 is connected to the shaft 80 by a nut 84 with a ball bearing support 86 trapped between the cone end and the nut 84. The ball bearings 88 locate in suitably positioned indents 90 formed in the internal surface of the outer sleeve members 36 to lock the inner sleeve member to the outer sleeve member. Downward movement of the central rods 37 caused by rotation of the grip 68 removes the ball bearings 88 from the indents 90 in which they are currently located to enable the outer sleeve to be moved relative to the inner sleeve. A vertical series of spaced indents is provided to enable the inner sleeve member 34 to be positioned at any one of several selected heights along the length of the outer sleeve member 36 simply by imparting relative movement between the inner and outer sleeves until the ball bearings locate in the indents at the selected new leg length.

To convert the walking stick illustrated in FIGS. 1 and 2 to the seat shown in FIG. 3 of the drawings, the caps 10, 14 are first removed and the three elongate arm members 18 pivoted outwardly. The fabric seat is then automatically positioned as shown in FIG. 3. The leg members 32 are then pivoted outwardly to define the tripod legs for supporting the seat. The length of anyone of the legs can be varied as described to accommodate any unevenness in the ground. To convert the seat back into a walking stick, these steps are simply carried out in the opposite order.

It will be appreciated that the foregoing is merely exemplary of convertible walking sticks in accordance with the invention and that modifications can readily be carried out without departing from the scope of the claims set out in the appended claims.

What is claimed is:

1. A walking stick which includes an upper section and a lower section connected by a rotatable boss assembly, said upper section comprising three elongate arm members each pivotal about a hinge located on an upper surface of the boss assembly between a first position in which one of the three elongate arm members is generally upstanding and lies generally parallel with the other two elongate arm members and a second position in which one of the three elongate arm members is inclined at an angle to the other two elongate arm members, said lower section comprising three elongate leg members each including an inner elongate member located telescopically within a hollow outer sleeve and each having an upper end positioned for pivotal movement relative to the boss assembly between a first position in which one of the three elongate leg members is generally upstanding and lies generally parallel to the other two elongate leg members and a second position in which one of the three elongate leg members is inclined at an angle to the other two elongate leg members, said boss assembly comprising an upper member which supports the hinges for the elongate arm members and a lower member formed with an opening into which the upper ends of the inner elongate members project, said boss member having an under surface which is shaped to include a downwardly projecting dome-shaped surface against which the upper ends of the inner leg members make contact whereby rotation of the central boss member (6) sequentially imparts vertical movement to each inner elongate member in turn to de-activate a locking mechanism located within each inner elongate member to enable a selected inner elongate member to slide within the respective hollow outer sleeve to increase the length of the respective elongate leg member, and a foldable seat member secured to and between each of the three elongate arm members of the upper section which, when the elongate arm members are in their inclined positions, defines a seat and when the elongate arm members are in their generally upstanding positions is hidden from view between the inner surfaces of the arm members.

2. A walking stick as claimed in claim 1 characterised in that the boss assembly further includes a central member positioned between the upper and lower boss members and wherein the lower member includes an upstanding spindle which passes through communicating bores formed in the central and upper boss members, the upper boss member being rotatable relative to the central and lower members.

* * * * *